United States Patent [19]

Weder et al.

[11] 4,124,135

[45] Nov. 7, 1978

[54] HINGED PLASTIC EASTER EGG

[75] Inventors: Erwin H. Weder, Highland, Ill.; Donald E. Weder, Hobart, Okla.

[73] Assignee: Highland Manufacturing and Sales Co., Inc., Highland, Ill.

[21] Appl. No.: 751,963

[22] Filed: Dec. 17, 1976

[51] Int. Cl.[2] ..... B65D 11/02; B65D 81/36

[52] U.S. Cl. ..... 220/4 B; 220/339

[58] Field of Search ..... 220/4 B, 4 E, 339, 334

[56] References Cited

U.S. PATENT DOCUMENTS

| | | | |
|---|---|---|---|
| 2,706,065 | 4/1955 | Stone | 220/4 B |
| 2,754,642 | 5/1956 | Herman | 220/4 B |
| 2,998,896 | 9/1961 | Miller | 220/4 B |
| 3,043,354 | 7/1962 | Fitzgerald | 220/339 |
| 3,567,013 | 3/1971 | Tannenbaum | 220/339 |
| 3,592,354 | 7/1973 | Nielson | 220/334 |
| 3,949,872 | 4/1976 | Paudras | 220/334 |

*Primary Examiner*—George E. Lowrance
*Attorney, Agent, or Firm*—Clarence A. O'Brien; Harvey B. Jacobson

[57] ABSTRACT

A hollow, plastic Easter egg constructed of two halves connected together by a plastic living hinge of unitary construction with the two halves being retained in closed position by a latch structure in the form of a continuous peripheral rib and peripheral groove on telescoping end portions of the two halves so that the hinge line of separation between the two halves are substantially concealed. The two halves of the Easter egg may be opened or closed to enable candy, toys, figurines or any other items desired to be placed therein so that they will appear to be inaccessible but yet the egg can be opened to provide access to the items interiorly thereof with the unitary hinge retaining the two halves of the egg in connected relation when the two halves are hinged to their open position.

1 Claim, 6 Drawing Figures

HINGED PLASTIC EASTER EGG

BACKGROUND OF THE INVENTION

1. Field of the Invention

The present invention generally relates to an Easter egg and more particularly a hollow, plastic egg of one piece construction having two halves hingedly interconnected by a very narrow and thin and substantially unnoticeable "living" hinge with the facing edges of the two halves being telescopic and provided with a continuous peripheral rib and groove which releasably secures the two halves of the egg in abutting relation with the line of juncture between the two halves being substantially unnoticeable.

2. Description of the Prior Art

Prior U.S. Pat. No. 2,998,896, issued to J. H. Miller, Sept. 5, 1961, discloses an Easter egg of two halves which are completely separable and provided with a latch structure releasably securing the two halves together. However, when the two halves of this egg are separated, they become completely independent and can become misplaced. Also, the latch fingers are rather difficult to manipulate, especially by small children, and are relatively difficult to manufacture.

SUMMARY OF THE INVENTION

An object of the present invention is to provide a hollow, plastic Easter egg of one piece construction divided into two halves along either the minor axis or the major axis with the two halves being permanently connected by a narrow, thin "living" hinge and the adjacent edges of the two halves being releasably secured together by a telescopic connection which includes a continuous peripheral rib and a continuous peripheral groove to provide a secure connection between the halves of the egg but enabling separation thereof with the juncture between the two halves of the eggs as well as the hinge being substantially concealed or unnoticeable.

Another object of the invention is to provide an Easter egg in accordance with the preceding object in which the size and configuration of the egg may vary and the egg may be constructed of transparent or translucent plastic material which may be clear or tinted any suitable color or the egg may be opaque and of any suitable color with the egg preferably being constructed of plastic material such as polyethylene or polypropylene or any other suitable plastic material which renders the egg relatively inexpensive to manufacture using conventional manufacturing techniques and provides a secure hinged connection between the halves of the egg to prevent the two halves from becoming separated and misplaced.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
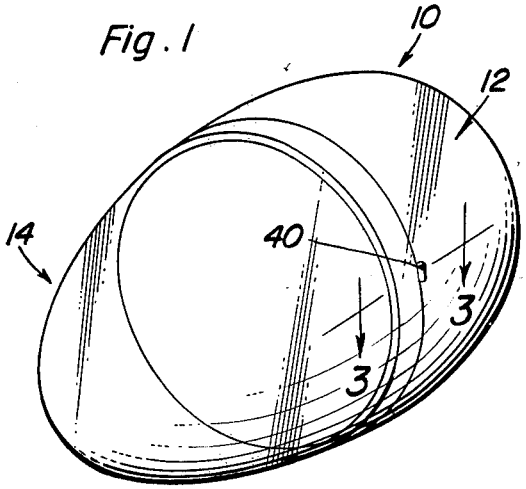
FIG. 1 is a perspective view of the Easter egg of the present invention in a closed position.

Referring now specifically to FIGS. 1-4, the Easter egg illustrated therein is generally designated by numeral 10 and includes a hollow shell divided into two generally equal halves 12 and 14 with the half designated by numeral 12 being simulative of the half of an egg having the air cell therein while the half 14 includes a more pointed or more sharply tapering end portion so that the overall configuration of the shell is in the form of an egg with the shape and size of the egg being variable. The halves 12 and 14 each include a continuous wall 16 and 18 respectively of plastic material having a thickness which provides substantial rigidity but the circular end edges of the walls 16 and 18 provides some degree of flexibility with the walls 12 and 14 being constructed of plastic materials such as polyethylene or polypropylene.

The half 12 of the egg 10 includes a circular end edge 20 of reduced thickness which is formed by a peripheral recess in the outer surface which terminates in a shoulder 22 spaced axially a short distance from the end edge 20. A peripheral rib or bead 24 is provided on the external surface of the reduced thickness end portion of the wall 16 generally intermediate the end edge 20 and the shoulder 22 with this reduced thickness area being designated by numeral 26 and which is adapted to telescope into the other half of the egg with the rib 24 being continuous peripherally of the egg half 12 as is the shoulder 22 and end edge 20.

Figure 3:
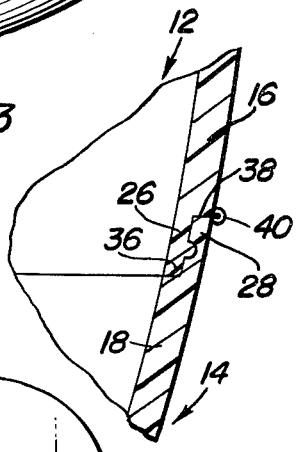
FIG. 3 is a fragmental sectional view, on an enlarged scale, taken along section line 3—3 of FIG. 1 illustrating the specific construction of the rib and groove latch connection between the two halves of the egg and the living hinge when the egg is closed.
Figure 2:
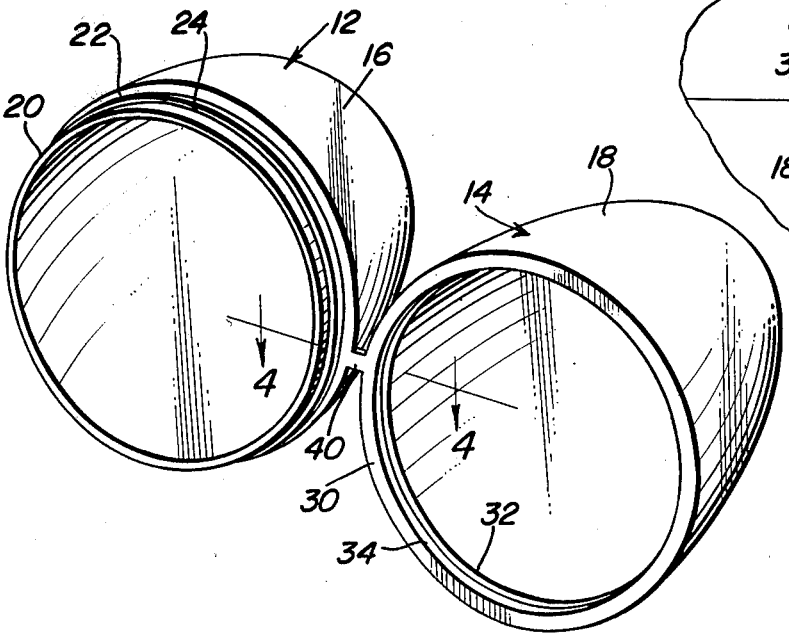
FIG. 2 is a perspective view of the Easter egg in an open condition with portions of one-half of the egg broken away.
Figure 4:
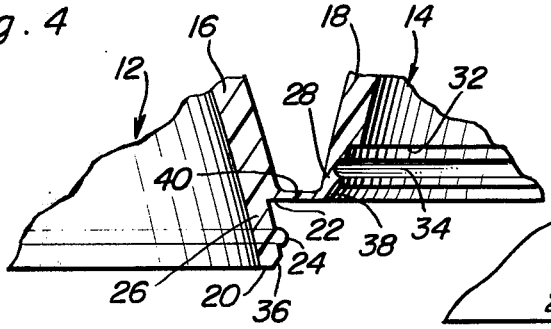
FIG. 4 is a fragmental sectional view, on an enlarged scale, taken substantially along section line 4—4 on FIG. 2 illustrating the same structure as in FIG. 3 but with the egg in open position.

The egg half 14 is likewise provided with a reduced thickness area of generally the same length as the reduced thickness area 26 except that the exterior of the reduced thickness area 28 is flush with the exterior surface of the wall 18 whereas the exterior surface of the reduced thickness area 26 is spaced inwardly from the exterior surface of the wall 16. The reduced area 28 includes an end edge 30 on the wall 18 and a shoulder 32 spaced axially therefrom. Intermediate the end edge 30 and shoulder 32, a peripheral groove 34 is provided which receives the rib 24 when the reduced thickness area 28 is telescoped over the reduced thickness area 26 as illustrated in FIG. 3. Thus, the continuous peripheral rib 24 received in the continuous peripheral groove 34 provides a continuous latch or connection between the two halves 12 and 14. However, the connection between the two halves can be separated by flexing the portions of the walls 16 and 18 adjacent the end edges 20 and 30 in an inward manner thus causing sufficient deformation of the end edges and adjacent portions of the egg halves to disengage the groove and rib.

To facilitate telescopic insertion of the male reduced thickness area 26 into the female reduced thickness area 28, the end edge 20 is provided with a tapered outer corner or chamfer 36 and correspondingly, the inner corner of the end edge 30 is provided with a bevel or chamfer 38. When assembled, the walls 16 and 18 are coextensive with each other and the exterior surface thereof is substantially smooth and continuous across the line of juncture thus rendering the juncture between the two halves 12 and 14 substantially concealed or unnoticeable. The relative diameters of the telescopic portions and the ribs and grooves are such that the inherent resiliency and memory characteristics of the plastic material from which the halves 12 and 14 of the egg 10 are constructed will enable frictional retention and resilient retention of the peripheral rib in the groove with the lateral deflection of the end edges of the halves 12 and 14 being sufficient to disengage the rib from the groove. For example, when the egg is closed, it is only necessary to grasp the egg at diametrically opposed points along the line of juncture therebetween and squeeze inwardly gently with sufficient force to cause a portion of the end edges to become disengaged due to the outward bulging of the end edge portions of the halves 12 and 14 at a point in 90 degree peripheral relation to the points of application of pressure due to the radius of the curve of the end edge decreasing at this point as diametrically opposed points of the egg are moved toward each other.

A very narrow and thin hinge 40 interconnects the egg halves 12 and 14. The hinge 40 is in the form of a very narrow and thin "living" hinge of polyethylene or polypropylene that is integral with and of unitary construction with the walls 16 and 18. The strip defining the hinge 40 is connected with the peripheral edge of the shoulder 22 at one end and at its other end, it connects with the periphery of the end edge 30 of the egg half 14. The length of the hinge 40 is adequate to enable the outside corner of the end edge 30 to pivot and move into engagement with the adjacent portion of the shoulder 22 on the egg half 12. During pivotal movement of the two halves, the hinge serves to retain alignment of the two halves and the inclined or chamfered corners guides the reduced thickness area 26 interiorly into the reduced thickness area 28 and end pressure exerted on the remote ends of the two halves 12 and 14 will cause complete telescoping of the reduced thickness area 26 into the reduced thickness area 28. Engagement of the rib 24 with the groove 34 serves as a continuous lock or latch peripherally of the circumference of the egg with the hinge 40 being substantially concealed or unnoticed since it will be substantially flush with the external surface of the walls 16 and 18 which it connects. The hinge will enable substantial flexing and relative movement of the halves when in the open position and will maintain the two halves in assembled condition thus eliminating the misplacement of one of the halves.

The size of the egg may be such that candy, such as jelly beans and the like, small toys, figurines and the like to be placed interiorly thereof with the closed egg presenting somewhat of a mystery to observers since there does not appear any way to gain access to the articles disposed interiorly of the egg. Thus, the egg not only provides a unique storage area for the articles but also provides an intriguing device to children since the capacility of opening and closing the egg lets the child solve the problem of gaining access and also developing manual dexterity and skills when opening and closing the egg.

Figure 5:
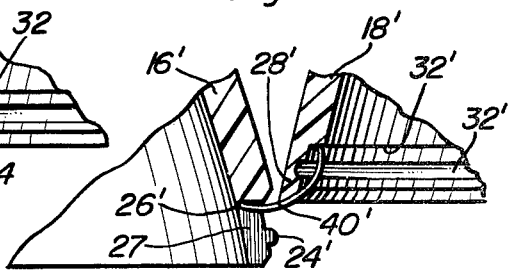
FIG. 5 is a fragmental sectional view similar to FIG. 4 but illustrating the living hinge oriented internally of the egg.

FIG. 5 illustrates another embodiment of the invention in which the hinge is disposed interiorly of the walls and completely concealed when the egg is closed. The same reference numerals are used to identify the structure in FIG. 5 as in FIG. 4 except that the reference numerals are primed. In this construction, the hinge 40' is partially received in a notch 27 formed in the reduced thickness area 26' with the hinge strip 40' being connected to the inner edge of the notch and extending to the inner edge of the shoulder 32' on the reduced thickness area 28'. When the reduced thickness areas 26' and 28' are telescoped together, the hinge strip 40' will be disposed interiorly of the peripheral walls 16' and 18' and be completely concealed. The hinge strip 40' operates in exactly the same manner as the embodiment of the hinge illustrated in FIGS. 1–4 with the notch 27 enabling the hinge strip 40' to permit the shell halves to be oriented in the open position as illustrated in FIG. 5.

Figure 6:
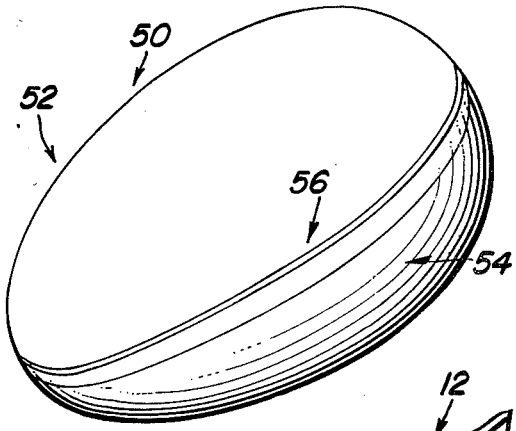
FIG. 6 is a perspective view of the egg similar to FIG. 1 but illustrating the line of separation along the major axis of the egg.

FIG. 6 illustrates another embodiment of the egg designated generally by reference numeral 50 in which the two halves are generally designated by the numeral 52 and 54 with the line of juncture between the two halves generally being designated by numeral 56 and being disposed lengthwise of the egg or along the major axis of the egg. Other than locating the line of juncture or separation between the two halves along the major axis rather than the minor axis, the structure of the latch and hinge is the same.

The hinged halves of the egg may be formed in an injection molding machine or the like with the thickness of the "living" hinge being approximately 0.010 inch to 0.015 inch. Depending upon the thickness of the walls of the egg shell halves, the interior of the halves, adjacent the telescoping areas, may be thickened or rigidified by internal ridges or the like. The plastic material may be transparent, color tinted or clear, translucent of any suitable color or opaque of any suitable color or of any other construction with the exact shape of the egg being varied but generally having an appearance similar to conventional poultry eggs.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An Easter egg having an open position and a closed position, comprising a one-piece, hollow shell of plastic material divided into two halves with the two halves being connected by a narrow, thin, flexible hinge of plastic material of integral construction with the two halves and enabling limited universal relative movement of the two halves and flexing of the edges of the halves when the egg is open, and means providing a continuous latch engagement about the full periphery of each of said halves along the line of separation between the two halves, said latch engagement means including a continuous male reduced edge area, including an essentially horizontal shoulder, on one of the halves of the shell and a continuous female reduced edge area on the other half of the shell for telescopic engagement, one of the reduced edge areas including a continuous peripheral groove formed about the full periphery of said reduced edge area and the other reduced edge area including a continuous peripheral rib formed about the full periphery of said reduced edge area, the rib being frictionally and resiliently received in the groove for releasably securing the halves of the egg together when closed, said hinge consists of only a single "living" hinge strip disposed exteriorly of the egg shell when the egg is closed, said hinge strip being anchored to the outer edge of the shoulder of the male reduced edge area and the outer edge of the female reduced edge area, and said hinge being of such a length as to retain alignment of said two halves of said egg shell when the egg is open, in such a manner that the male and female edges are automatically aligned and forced to fit together when the egg is being closed, and wherein said hinge is substantially flush with the outer surface of said egg shell when the egg is closed such that the hinge is virtually invisible to the human eye upon cursory examination of the closed egg.

* * * * *